United States Patent [19]

Wolar

[11] 4,325,061

[45] Apr. 13, 1982

[54] PROTECTIVE MEANS FOR ATTACHMENTS AFFIXED TO ELECTRICALLY OPERATED BEDS

[76] Inventor: William Wolar, 59 Fremont Rd., North Tarrytown, N.Y. 10591

[21] Appl. No.: 200,990

[22] Filed: Oct. 27, 1980

[51] Int. Cl.[3] ..... G08B 21/00

[52] U.S. Cl. ..... 340/679; 5/424; 200/61.43; 340/540

[58] Field of Search ..... 340/679, 665, 686, 540; 5/63, 424, 508; 200/61.43

[56] References Cited

U.S. PATENT DOCUMENTS

| | | | |
|---|---|---|---|
| 3,220,019 | 11/1965 | Nelson | 5/62 |
| 3,709,372 | 1/1973 | Alexander | 211/74 |
| 3,712,965 | 1/1973 | Dalton | 200/17 R |
| 3,774,149 | 11/1973 | Bennett | 340/686 |
| 3,866,004 | 2/1975 | Nawrocki | 200/61.42 |
| 3,875,356 | 4/1975 | Heim et al. | 200/52 R |
| 4,060,160 | 11/1977 | Lieber | 192/134 |

*Primary Examiner*—Glen R. Swann, III

*Attorney, Agent, or Firm*—Eugene E. Geoffrey, Jr.

[57] ABSTRACT

The attachment includes switch means, a spring loaded switch actuator overlying and coextensive with the upper surface of the attachment, an electric control interconnected with the power supply to the bed and said switch so that elevation of said bed is automatically terminated upon contact of said switch actuator with an obstacle above the bed.

13 Claims, 9 Drawing Figures

PROTECTIVE MEANS FOR ATTACHMENTS AFFIXED TO ELECTRICALLY OPERATED BEDS

This invention relates to a protective means for use with electrically operated beds of the type employed in hospitals, nursing homes and the like and more specifically to means for use with bed attachments such as infusion standards, and other devices, which generally extend above the head of the bed, to limit upward motion of the bed in the event the attachment carried thereby engages another object such as a wall lighting fixture, shelf, supply pipes for liquids and gases and the like.

OBJECT OF THE INVENTION

It is frequent, particularly in hospitals, that infusion standards as well as trapeze-like structures are affixed to beds for use by patients and are elevated and lowered with the bed. In as much as lighting fixtures and other structures often project from the wall above the bed, attachments extending above the bed can strike such structures and cause not only considerable material damage but also serious injury to a patient in the bed. This invention overcomes this difficulty and provides a novel and improved structure that will automatically terminate upward motion of the bed immediately upon contact with any obstruction above the bed.

Another object of the invention resides in the provision of novel and improved protective means for use with attachments affixed to electrically operated beds to interrupt upward motion of the bed in the event the attachment contacts an obstruction of any kind.

SUMMARY OF INVENTION

The invention is applicable for use with a great variety of attachments adapted to be secured to the head portion of an electrically operated bed and includes normally open switch means carried by the attachment, switch actuating means positioned on the attachment in such a manner that the actuating means will engage a wall obstruction in advance of the attachment, relay means interconnected with the power supply to the bed and operable upon actuation of the switch to interrupt the power and thus terminate continued elevation of the bed.

The above and other objects and advantages of the invention will become more apparent from the following description and accompanying drawings forming part of this application.

IN THE DRAWINGS

Figure 8:
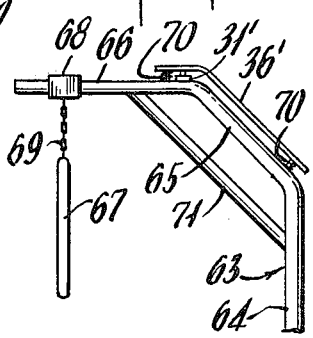
Figure 9:
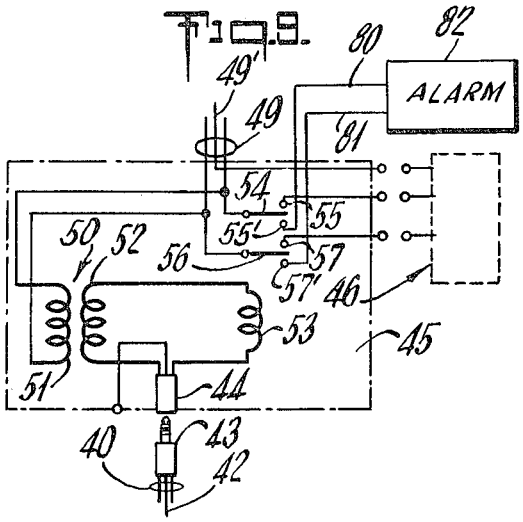

FIG. 8 is a fragmentary side elevational view of a trapeze-like structure adapted for attachment to the head of a bed to assist a patient in lifting himself for exercising and other purposes and embodying a protective device in accordance with the invention; and FIG. 9 is one embodiment of a circuit diagram illustrating one mode of interrupting the elevation of a bed in the event an infusion standard or other structural element on the bed engages an obstacle on the wall.

DETAILED DESCRIPTION

Considerable difficulty has heretofore been encountered with the attachment of infusion standards and other mechanical structures to a bed such as a hospital bed for the treatment and convenience of a patient. The principal difficulty involved the interference of a bed attachment with a light fixture or other wall obstruction as the bed is raised. With light fixtures, severe damage results not only to the light fixture and the attachment but even more important the patient may be seriously injured. Heretofore, light fixtures have been designed which tilt up on engagement with a bed attachment or in the alternative are placed high enough above the bed to avoid any possibility of such engagement. In the latter case, however, the light fixture is often much too high to be of real value to the patient. Other wall obstructions such as outlets for oxygen, air, liquid and the like and electrical boxes may also be positioned on the wall above or adjoining the bed and severe damage can also occur should a standard or other device affixed to the bed engage such outlets or electrical devices.

This invention overcomes the foregoing difficulties and provides means on the infusion standard or other attachment which upon engagement of any wall obstruction, as the bed is being raised, will automatically terminate the operation of the bed and thus avoid damage to either the wall obstruction or the attachment affixed to the bed and protect the patient from possible injury.

Figure 1:
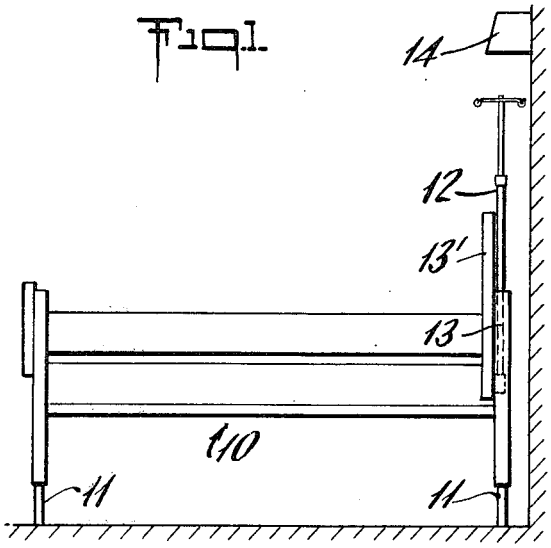
FIG. 1 is a side elevational view of a conventional hospital bed with an infusion standard or so-called IV pole affixed to the head of the bed.
Figure 2:
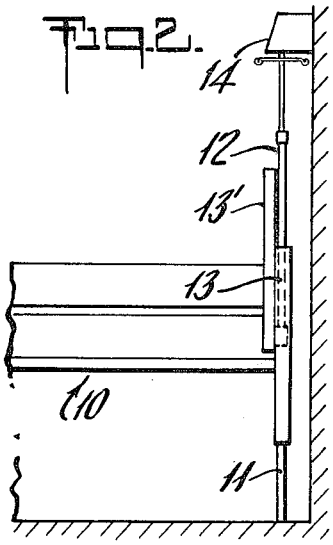
FIG. 2 is a side elevation of a fragmentary portion of the bed shown in FIG. 1 but in raised position and showing the infusion standard engaging an obstruction such as a light fixture on the wall when the bed is raised.

Referring now to the drawings and more specifically to FIGS. 1 and 2, an adjustable bed such as a hospital bed denoted in these figures by the numeral 10 includes among other features elevating means in the form of telescoping legs 11 operated by an electric motor not illustrated in these figures. The specific elevating means is well known in the art and accordingly a detailed description is not deemed necessary. In the treatment of a patient, a transfusion standard, such as the standard 12, is often affixed to the frame portion 13 forming part of the head of the bed and is designed to hold inverted bottles for intravenous transfusion. Should the bed be raised as illustrated in FIG. 1 when an infusion standard 12 is in place thereon, the standard can engage a wall obstruction such as the lighting fixture 14 or other equipment which may be mounted on the wall adjoining the head of the bed with the result that damage may not only occur to the wall obstruction and the standard but a patient can be seriously injured. To avoid this difficulty, this invention provides novel and improved protective means, one form of which is illustrated in FIG. 3 through 6 and 9.

Referring to FIGS. 3 through 6 illustrating an infusion standard in accordance with the invention, the standard is generally denoted by the numeral 15 and includes telescoping sections 16 and 17 with the section 16 carrying a compression fitting generally denoted by the numeral 18 in order to adjust the height of the standard. The lower end of the standard section 16 includes a collar 19 threadably engaging the bottom end of the standard section 16 and an elongated pin 20 extending below the collar 19. This pin engages an opening 21 in the bracket 22 (see FIG. 6) which is affixed to the bed frame portion 13. If desired, the bracket 22 can be fabricated in the form of a clamp having screws 23 to securely affix the infusion standard thereto.

The upper end of the infusion standard 17, in accordance with the invention, includes a housing generally denoted by the numeral 24 and consists of a tubular portion 25 affixed to the infusion standard section 17 by means such as the screw 26 and an upper tubular portion 27. A transverse rod 28 having hook-like portions 29 is affixed to the housing section 27 by a weld 30 or other suitable means. The hook-like portions 29 are designed to hold transfusion containers in the usual manner. The housing section 27 further includes a push-button switch 31 affixed within an opening 32 in the upper end of the housing portion 27 by means of a threaded collar 33 and cooperating nut 34. The push-button 35 extends upwardly and upon depression actuates the switch 31.

The switch 31 is operated by an actuating bar 36 affixed to the transverse rod 28 by elongated pins 37 extending through cooperating openings in the bar 36 and rod 28. Springs 38 surround each pin 37 and bear against the bar 36 and washers 39 carried by the pins and adjoining the rod 28. The springs 38 maintain the bar 36 in an upper position and in the instant embodiment of the invention the switch 31 is in a normally open position.

With the foregoing arrangement and with the infusion standard 15 affixed to a hospital bed or the like, as the bed is raised and the infusion standard encounters an obstruction, the actuating bar 36 will be depressed and function to close the switch 31 before any damage occurs. As will be described, closure of the switch 31 automatically interrupts power to the bed and immediately prevents further elevation thereof.

Figure 3:
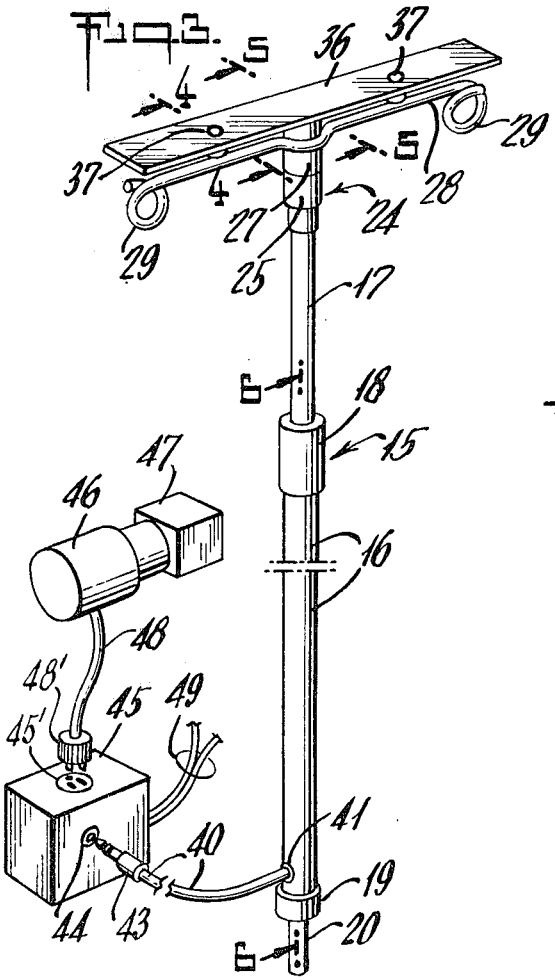
FIG. 3 is a perspective view of an infusion standard in accordance with the invention and interconnected with an electric motor utilized to raise and lower a bed such as that illustrated in FIGS. 1 and 2.
Figure 4:
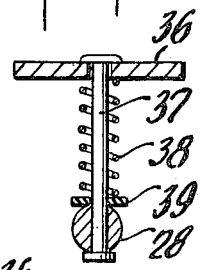
FIG. 4 is a cross sectional view of FIG. 3 taken along the line 4—4 thereof.
Figure 5:
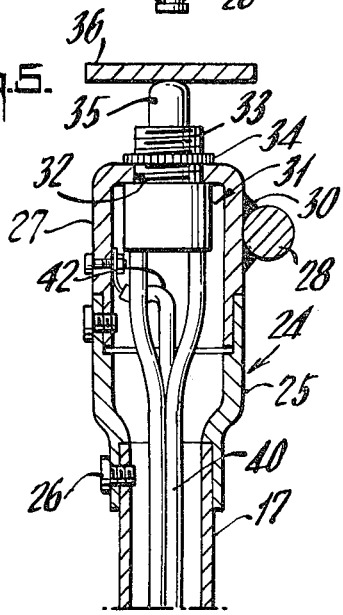
FIG. 5 is a cross sectional view of FIG. 3 taken along the line 5—5 thereof.
Figure 6:
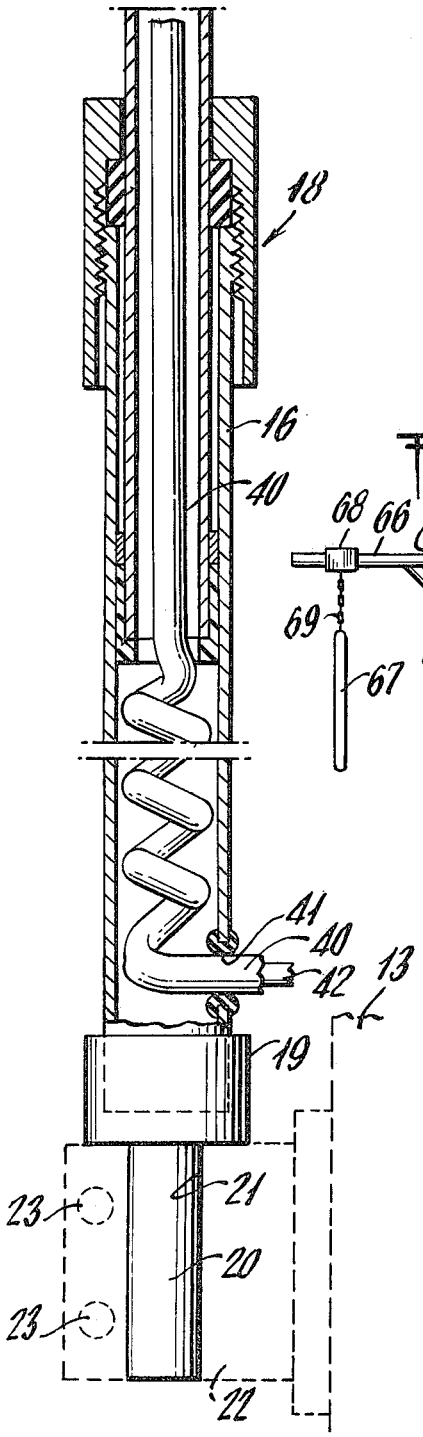
FIG. 6 is an enlarged cross sectional view of FIG. 3 taken along the line 6—6 thereof and illustrating diagramatically the bracket means affixed to a bed for support of the infusion standard.

Interconnection of the switch 31 with the bed elevating motor is accomplished by a coiled control cable 40 connected to the switch 31, as illustrated in FIG. 5, extending through the telescoping sections 16 and 17 of the standard and emerging through an opening 41 at the bottom of the standard section 16 as illustrated more clearly in FIGS. 3 and 6. The cable 40 also includes a ground lead 42 grounded to the housing portion 27 by a nut and bolt or other suitable means. The cable 40 together with the ground lead 42 is connected to a three circuit plug 43 as illustrated in FIG. 3 for connection to a receptacle 44 mounted on a control box 45. The bed operating motor 46, having a cooperating gear box 47, is connected via the lead 48 to a plug 48′ for engaging a receptacle 45′ on the control box 45, and power for operation of the motor and control means is provided by the power supply cable 49. The circuitry disposed within the box 45 for operation of a motor 46 is illustrated in FIG. 9.

Referring to FIG. 9, the control box 45 includes a transformer 50 having a high voltage primary 51 connected to the incoming power line 49 and a low voltage secondary 52 producing 6 to 24 volts as may be desired. The transformer 50 is connected to the coil 53 of a relay having normally closed contacts 54–55 and 56–57. The receptacle 44 is connected in series with one side of the relay coil 53 so that in the absence of the plug 43 in the receptacle 44, the relay coil 53 will remain de-energized with the result that the contact pairs 54–55 and 56–57 will be in a closed position. With this condition, power will be fed from the power line 49, having a ground lead 49′, through the contact pairs to the motor 46 which operates the bed. The ground lead 49′ is connected to the control box housing and to the housing of the motor 46. Accordingly, the standard control for the bed can be operated to raise and lower the bed. When the plug 43 is in engagement with the receptacle 44 and the switch 31 is actuated because of engagement of the bar 36 with a wall obstruction, the circuit to the relay coil 53 is closed and the contact pairs 54–55 and 56–57 are opened, interrupting the supply of energy to the motor 46 and thereby terminating further elevation of the bed. The height of the actuating bar 36 above the rod 28 of the infusion standard is adjusted so that the switch 31 is actuated when any portion of the bar contacts an obstruction. In this way, elevation of the bed is terminated prior to complete compression of the springs 38.

Figure 7:
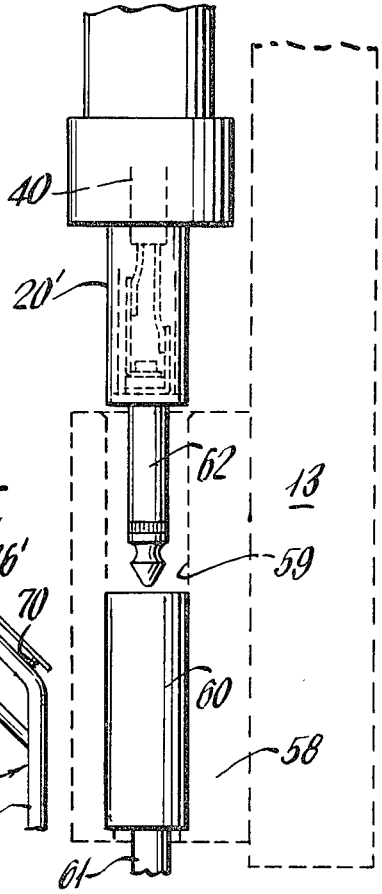
FIG. 7 is a fragmentary side elevational view of a modified form of an infusion standard in accordance with the invention together with a receptacle affixed to the bed for supporting the standard.

A modified form of the invention is illustrated in FIG. 7 and provides means for automatically connecting the switch 31 to the controlling means 45 when the infusion standard is affixed to the bed frame 13. In this form of the invention, the bracket affixed to the bed frame and denoted by the numeral 58 has an elongated opening 59 extending therethrough. The lower portion of the opening 59 includes a socket 60 having a control cable 61 extending from the bottom thereof. The post or pin 20 extending from the bottom of the infusion standard section 16 and denoted by the numeral 20′ has an electrical plug 62 extending from the bottom thereof. This plug is connected to the control cable 40 within the standard. While the illustrated plug merely has two control contacts, it is well known that such plugs may include a third contact for the purpose of carrying the ground from the switch 31 and standard 15 to the control box 45. A cable 61 may be connected to the receptacle 44 by means of a suitable plug which remains permanently in position on the receptacle or in the alternative the cable 61 can be wired directly to the transformer secondary 52 and relay coil 53 as illustrated. With this arrangement, when the infusion standard is placed in position on the bed frame 13 so that the post 20′ engages the opening 59, the plug 62 will engage the socket 60 and automatically connect the switch 31 to the transformer secondary 52 and relay coil 53 as previously described. With this arrangement, actuation of the actuating bar 36 will function to open the relay as previously described.

While the invention has thus far been described in connection with an infusion standard affixed to a bed having electrically operated elevating means, the invention is equally useful with other devices affixed to the head of the bed for a patient's treatment or convenience. One such device or structure is illustrated in FIG. 8 and is utilized to enable the patient to lift himself to a sitting position. It comprises a basic frame element 63 consisting of an upright portion 64 secured either to the bed frame 13 or head board 13′, a diagonal section 65 and a horizontal section 66 extending outwardly over the patient. A ring 67 is affixed to a bracket 68 by means of a chain 69 and the bracket 68 can be adjustably positioned on the horizontal frame portion 66. In order to interrupt elevation of the bed should the structure 63 engage a wall obstruction, a switch 31' similar to the switch 31 shown for instance in FIG. 5 may be mounted on the horizontal frame portion 66. An actuating bar 36' overlies the inclined frame portion 65 and at least part of the horizontal portion 66. The actuating bar is spring mounted on the frame elements 65 and 66 by means of springs 70 to function in substantially the same manner as the bar 36 illustrated in FIGS. 3 through 5. In the illustrated embodiment, a diagonal support 71 is provided on the frame 63.

With the structure as shown in FIG. 8, any contact between the actuating bar 36' and a wall obstruction will actuate the switch 31', which in turn is interconnected with the control 45 in the same manner as the switch 31, and thereby terminate elevation of the bed.

In the several illustrated embodiments of the invention, the relay 53 is normally de-energized and interruption of the bed elevating circuit is accomplished by energizing the relay as described. If desired, appropriate circuitry well within the skill of the art can be utilized so that the relay 53 would be in a normally energized position in order to enable the bed to be elevated in which case the switches 31 and 31' would be normally closed switches and would function to open the relay circuit upon actuation to interrupt continued elevation of a bed.

Another aspect of the invention resides in the provision of an audible and visual alarm 82 (see FIG. 9) which may be activated in the event a bed attachment engages an obstacle upon being elevated. In FIG. 9, it will be observed that a second set of contacts 55' and 57' are associated with the movable contactors 54 and 56 so that de-energization of the coil not only opens the contact pairs 54–55 and 56–57 but also closes the contact pairs 54–55' and 56–57' and applies energy to the leads 80 and 81, the latter being connected to an audible and/or visual alarm 82.

In certain applications, it may be desirable to avoid the need for a direct connection between the switches 31, 31' and the control box 45. In such instances, attachments such as 15 and 63 may be provided with conventional transmitters and the control box 45 may include a receiver which functions to de-energize the relay coil 53 upon either the presence or absence of a signal as the case may be. Since transmitters and receivers are well known in the art and are considered the equivalent of direct wire connections, a detailed illustration and description is not deemed necessary.

The invention has been described as utilizing a push-button switch 31 or 31' as the case may be. It is to be understood that any type of switch may be employed such as a micro-switch and the like having a lever in place of a push-button for operation of the switch. Accordingly, the use of the term "push-button" as used herein is intended to include the operating element of the switch whether it be a push-button, lever or other switch operating device.

While only certain forms of the invention have been illustrated and described, it is understood that alterations, changes and modifications may be made without departing from the true scope and spirit thereof.

What is claimed is:

1. A protective device for use with an attachment affixed to a bed having electrically operated elevating means to interrupt continued elevation of the bed should the attachment encounter an obstacle adjoining the bed comprising switch means carried by said attachment, switch actuating means on said attachment and positioned to engage an obstacle in advance of said attachment, electric control means interconnected with said electrically operated elevating means and said switch means whereupon operation of said switch means by said actuating means will interrupt continued elevation of said bed.

2. A protective device according to claim 1 wherein said switch actuating means is spring loaded, overlies the top surface of said attachment and is at least coextensive therewith and wherein the total range of displacement of said actuating means is in excess of the displacement required to operate said switch means.

3. A protective device according to claim 2 wherein said control means includes a relay having a coil and normally closed contacts connected in series with said electrically operated elevating means and a power supply connected in series with said coil and switch whereby actuation of said switch will energize said coil and open said contacts to interrupt power to said electrically operated elevating means.

4. A protective device according to claim 2 wherein said switch actuating means comprises a bar overlying and carried by the upper surface of said attachment, spring means maintaining said bar in spaced relationship to said upper surface and said switch means includes push-button means in closely spaced relationship to the underside of said bar whereby depression of any portion of said bar will actuate said switch means.

5. A protective device according to claim 2 wherein said attachment is a transfusion standard having a transverse member for supporting inverted containers, said switch actuating means constitutes an element overlying and at least coextensive with said transverse member and spring means maintaining said element in spaced relationship to said member, said switch means is carried on the upper side of said member and includes a push-button in closely spaced relationship to said element, said standard includes a pin extending from the bottom thereof for engaging a standard support carried by said bed and further comprises an electric control cable connected to said switch means and extending through said standard, said standard including an opening at the base thereof through which said cable passes and means on the end of said cable for removably connecting said cable to said electric control means.

6. A protective device according to claim 5 wherein said pin extending from the bottom of said standard includes an electric plug extending from the bottom of said pin and said control cable is connected to said plug and said standard support includes a plug receptacle and second cable means connecting said receptacle to said electric control means whereby attachment of said standard to said bed automatically connects said switch means to said electric control means.

7. A protective device according to claim 2 wherein said attachment is a structure affixed to and extending upwardly from the bed frame, said switch actuating means constitutes at least one element overlying and coextensive with at least that portion of said structure which may contact an overhead obstacle, spring means holding said element in spaced relationship to said structure, said switch means comprises at least one switch carried by said structure and further comprising a push button in closely spaced relationship to said element and cable means connecting said switch to said electric control means.

8. A protective device according to claim 2 wherein said attachment includes an electric plug, said bed includes a plug receptacle and attachment support, said switch means is interconnected with said plug and said receptacle is interconnected with said electric control means.

9. A protective device according to claim 8 wherein said control means includes a relay having a coil and normally closed contacts connected in series with said electrically operated elevating means and a power supply connected in series with said coil and switch whereby actuation of said switch will energize said coil and open said contacts to interrupt power to said electrically operated elevating means.

10. A protective device according to claim 2 wherein said bed includes a support bracket and electric receptacle, said attachment includes an electric plug for engagement with said receptacle upon engagement of said engagement with said bracket, said plug is electrically connected to said switch means and said receptacle is connected to said electric control means.

11. A protective device according to claim 1 including an alarm operated upon actuation of said switch means.

12. A protective device according to claim 11 wherein said alarm is electrically activated, said control means includes relay means having a coil and sets of normally open and normally closed contacts, means interconnecting said coil with said switch means, connections between said normally closed contacts and said electrically operated elevating means whereby actuation of said switch means energizes said relay coil to open the normally closed contacts and close the normally open contacts and connections between the normally open contacts and said alarm whereby actuation of said switch means will activate said alarm.

13. A protective device for use with an attachment affixed to a bed having electrically operated elevating means to interrupt continued elevation of the bed should the attachment encounter an obstacle adjoining the bed comprising electric control means interconnected with said electrically operated elevating means, switch means interconnected with said control means and said attachment includes means resiliently retained in a normal position and movable to a second position upon engagement of an obstacle by said attachment to activate said switch means and interrupt continued elevation of said bed.

* * * * *